United States Patent [19]

Griffith

[11] Patent Number: 4,651,786

[45] Date of Patent: Mar. 24, 1987

[54] YARN METERING DEVICE

[75] Inventor: John D. Griffith, Boldon, England

[73] Assignee: Sulzer Brothers Limited, Winterthur, Switzerland

[21] Appl. No.: 660,517

[22] Filed: Oct. 12, 1984

[30] Foreign Application Priority Data

Oct. 15, 1983 [GB] United Kingdom ..... 8327676

[51] Int. Cl.[4] ..... D03D 47/36

[52] U.S. Cl. ..... 139/452; 242/47.01

[58] Field of Search ..... 139/452; 242/47.01, 242/47.12, 47.13

[56] References Cited

U.S. PATENT DOCUMENTS 4,298,172 11/1981 Hellstrom ..... 139/452
4,372,349 2/1983 Van Mullekom ..... 242/47.12
4,381,807 5/1983 Omezawa ..... 139/452
4,452,402 6/1984 Ghiardo ..... 242/47.01
4,550,754 11/1985 Lida ..... 139/452

FOREIGN PATENT DOCUMENTS 8300137 1/1983 PCT Int'l Appl. ..... 139/452
2038892 7/1980 United Kingdom ..... 139/452

*Primary Examiner*—Henry S. Jaudon
*Attorney, Agent, or Firm*—Robert B. Frailey

[57] ABSTRACT

A weft metering device including a stationary spool, a yarn supply arm for wrapping yarn to the spool, stop means co-operable with the spool for permitting yarn wrapped on the spool to be pulled axially off the spool and intermittently operable drive means for driving said stop means to enable a predetermined whole number of turns of yarn wrapped on the spool to be pulled axially off the spool.

5 Claims, 4 Drawing Figures

YARN METERING DEVICE

The present invention relates to a yarn metering device particularly for use in a fluid jet loom.

The metering device of the present invention is a modification of the metering device disclosed in our European patent application 82902075.9 (Publication No. 0084032) and reference should be made thereto for a full understanding of the present invention.

According to one aspect of the present invention there is provided a weft yarn metering device including a stationary spool having the usual yarn storage and yarn discharge regions, a yarn supply arm for wrapping yarn on the spool about its storage region, stop means co-operable with the spool for permitting yarn wrapped about the discharge region of the spool to be pulled axially off the spool and selectively intermittently operable drive means for driving said stop means to enable a predetermined whole number of turns of yarn wrapped on the spool to be pulled axially off the spool.

According to another aspect of the invention there is provided a weaving loom including a plurality of such weft metering devices characterized in that the drive means is controlled so as to accelerate from standstill prior to the next pick of the loom so as to have a predetermined number of turns of yarn wrapped around the spool for discharge during said next pick.

Various aspects of the present invention are hereinafter described with reference to the accompanying drawings, in which.

Figure 1:
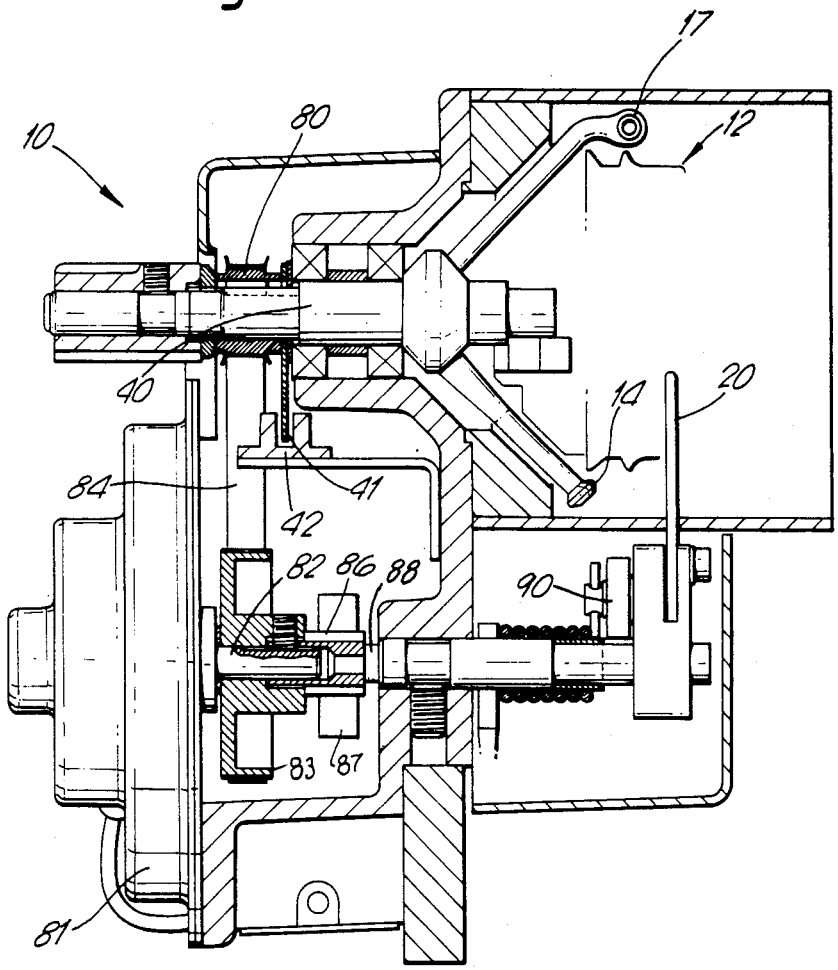
FIG. 1 is a fragmentary, partially phantom, axial cross-section through a preferred embodiment according to the present invention.

Referring initially to FIG. 1, the weft yarn metering device 10 includes a fixed spool 12, shown in phantom, on which weft yarn (not shown) is stored. The spool 12 is of a similar construction to that shown in our European publication No. 84032 provided with the usual yarn storage and discharge regions separated by the usual annular ridge.

A yarn supply arm 14 and yarn guide arm 17 are provided and are arranged to co-operate with the spool 12 in a similar manner to that described in our said European publication. The yarn supply arm 14 and yarn guide arm 17 are diametrically opposed relative to the axis of the fixed spool 12, and are rotatable in unison relative thereto. The yarn supply arm 14 is hollow so as to provide for the passage of the yarn therethrough, and is operative to wrap the yarn about the storage region of the spool 12. The yarn guide arm 17 picks up the yarn deposited by arm 14 on the storage region of the spool and transfers the yarn to, and rewraps it about, the discharge region of the spool 12. The foregoing structure and its mode of operation, of course, are well known in the art.

The supply arm 14 and guide arm 17 are mounted on a rotatable shaft 40 which has a pulley wheel 80 mounted thereon. A low inertia electric motor 81 of any conventional type is provided having an output drive shaft 82 on which is mounted a pulley wheel 83. A continuous belt 84 is trained about pulley wheels 80 and 83 in order to cause rotation of shaft 40.

The output shaft 82 is also provided with a toothed gear 86 which meshes with a toothed gear 87 mounted on a cam shaft 88 which is arranged to operate a cam follower 90 on which is mounted a yarn stop finger 20. The yarn stop finger 20 is arranged to operate in the same manner as that described in our said European publication, i.e. it is preferably arranged to ensure that during a single pick of the loom a predetermined whole number of turns of yarn wrapped on the spool are withdrawn axially from the discharge region of the spool 12 for delivery across the shed of warp yarns. The stop finger 20 is operative to control the release of the wrapped yarn from the fixed spool 12 in the conventional manner. The stop finger 20 is movable axially relative to the fixed spool 12 between a yarn holding position, whereat it restrains axial withdrawal of yarn windings from the spool, and a yarn release position, whereat it permits the yarn windings to be withdrawn axially from the spool.

The motor 81 is electronically controlled by a microprocessor 112 (FIG. 4) and is capable of accelerating from standstill to a predetermined constant speed and then decelerating back to standstill in a predictable and reproducable controlled manner. In order to locate accurately the shaft 40 in a particular reference position, the shaft 40 is provided with a radially projecting arm 41 which co-operates with a proximity sensor 42. The proximity sensor 42 enables the microprocessor to sense the position of the shaft and also count the number of rotations undergone.

Since the motor 81 is connected drivingly to both the yarn supply arm 14 and the yarn stop finger 20, those two elements are moved in synchronism. The yarn stop finger 20 is moved from one to the other of its two operating positions each time after the yarn supply arm 14 has been rotated through a predetermined number of complete rotations relative to the fixed spool 12 to wrap a predetermined number of complete yarn windings on the storage region of the spool. Thus, the movements of the stop finger 20 are controlled by the motor 81, since the finger is moved between its operative positions after the completion of a predetermined number of revolutions of the yarn supply arm 14 about the fixed drum 12.

In use several devices 10 are arranged side by side on a weaving loom and are used in synchronism to supply sequentially their respective yarns for insertion in the weave. In this way it is possible to select one or more weft yarns for a given pick and thereby create desired fabric patterns. Thus, the loom is provided with a patterning facility utilizing different selected weft yarns during successive picks.

The pattern sequence for the weft is controlled by the microprocessor 112 which would be suitably programmed to provide the desired pattern.

In order to enable a given metering device 10 to release its yarn at the correct time during the weaving cycle the microprocessor 112 is programmed to activate the relevant device 10 at a predetermined time in the weaving cycle so that the device is running at a constant speed when release of yarn is required.

The predetermined time for activating the relevant device 10 is conveniently determined by an electronic sensor 111 (FIG. 4) which is arranged to sense a selected rotational position of a drive shaft 110 within the loom.

Figure 3:
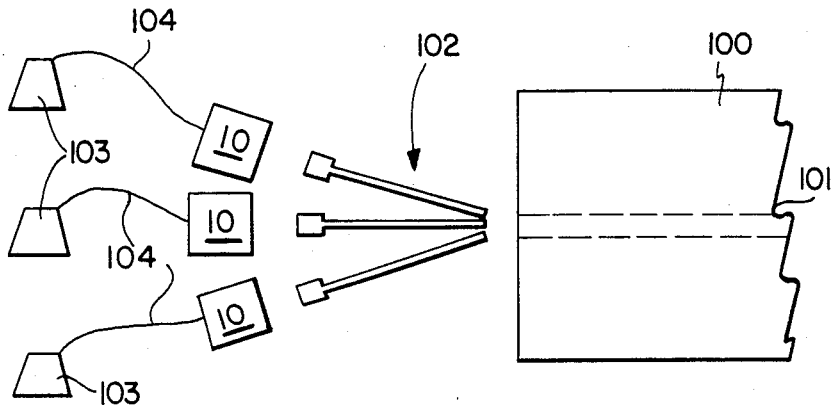
FIG. 3 is a schematic diagram illustrating a plurality of weft yarn metering devices embodying this invention arranged to supply their respective yarns to a single weaving loom.
Figure 4:
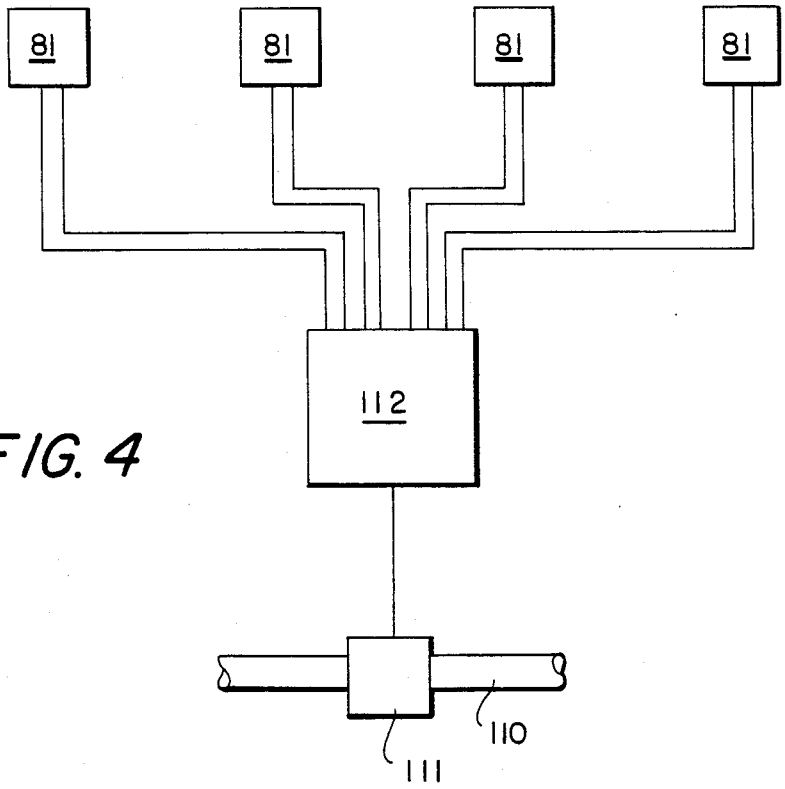
FIG. 4 is a schematic diagram illustrating a microprocessor used in the practice of the invention.

FIGS. 3 and 4 illustrate schematically the application of several weft yarn metering devices 10 for supplying a plurality of different weft yarns to a single weaving loom for the purpose of weaving a selected fabric pattern. More particularly, FIG. 3 illustrates schematically a loom 100 of the fluid jet type having the usual weft yarn insertion channel 101 and the usual plural air nozzles 102 for weft yarn insertion. A plurality of yarn metering devices 10 are interposed between the air nozzles 102 and packages 103 of weft yarn 104, each device 10 being separately associated with one of the yarn packages 103 and air nozzles 102.

FIG. 4 depicts schematically the relationship of the microprocessor 112 to the individual motors 81 for several devices 10 and the electronic sensor 111, which is mounted on the main drive shaft 110 of the loom 100. In operation, sensor 111 produces a reference pulse at a predetermined point during the loom cycle, i.e. at a selected rotational position of shaft 110. The reference pulse is fed to the microprocessor 112. The microprocessor indexes the reference pulse onto the next programmed pick by activating an idle device 10 for the next pick while deactivating the then active device 10 so that it will not feed yarn during the next pick. During operation of the active device 10, the microprocessor 112, utilizing the proximity sensor 42, counts the number of revolutions undergone by the shaft 40 of the active device 10. The microprocessor ensures that the predetermined number of revolutions of the yarn supply arm 14 are completed at the correct time in the loom cycle.

Of course, the selected weaving pattern is programmed into the microprocessor 112. Each weft yarn metering device 10 feeds its yarn 104 to a separate air nozzle 102, which operates in a conventional manner in that compressed air is supplied thereto at the appropriate time in the loom cycle. The air may be supplied selectively to each active nozzle 102 at the command of the microprocessor 112, or it may be supplied simultaneously to all nozzles irrespective of which of the yarns 104 is fed to the loom 100.

Figure 2:
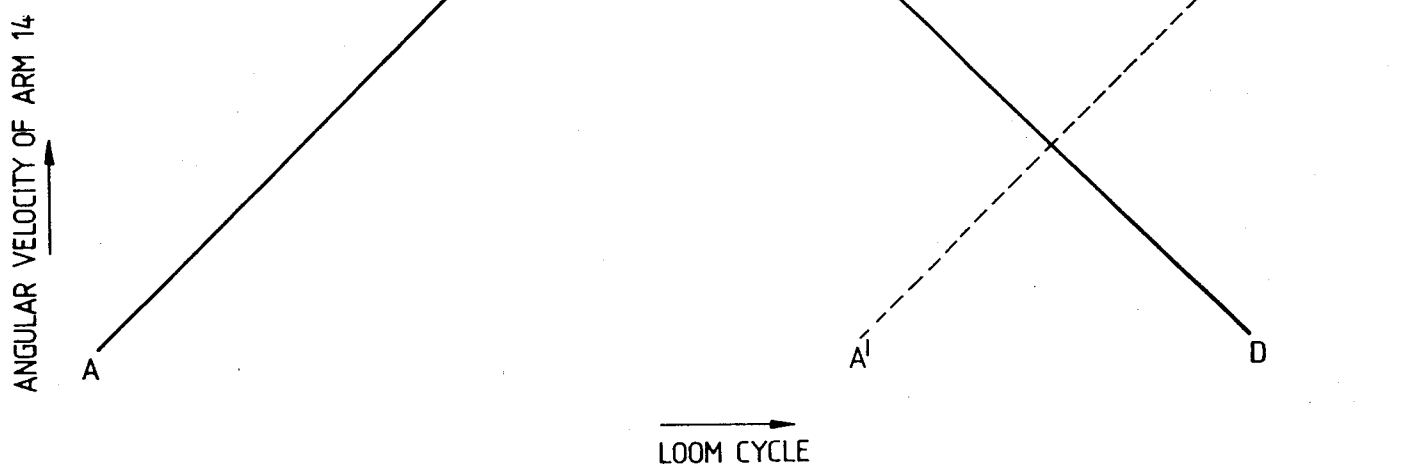
FIG. 2 is a diagrammatic representation of the operating characteristics of the device.

Operation of a device 10 is illustrated schematically in FIG. 2 wherein the angular velocity of yarn supply arm 14 is represented and is plotted against the angular position of the main shaft of the loom (loom cycle). Initially the microprocessor causes acceleration of the arm from point A (standstill) so as to reach point B within a defined time period. During acceleration the arm 14 undergoes a selected number of complete revolutions, i.e. x whole turns, around the fixed spool 12. From point B to point C the arm 14 rotates at an insertion speed which ideally is a constant speed and during this period the yarn is released from the fixed spool 12. From point B to point C the arm undergoes 2x turns. From point C to point D the arm 14 decelerates to a standstill and undergoes x turns.

Thus, the total number of whole turns of yarn discharged from the spool 12 during a pick of the loom equals 4x turns. During deceleration x turns of yarn are wrapped around the spool 12, and during acceleration x turns of yarn again are wrapped around the spool 12. Accordingly, at the moment stop finger 20 permits release of yarn there are 2x turns of yarn on the spool. Since yarn supply arm 14 continues rotating during yarn insertion, and undergoes an additional 2x turns around the spool before the stop finger 20 is moved to arrest the discharging yarn, a total of 4x turns of yarn are discharged during each pick.

The yarn stop finger 20 is moved from one position to the other position relative to its fixed yarn spool 12 every 2x yarn turns. Before it moves to release the yarn, there are 2x turns on the spool. During release of the yarn, arm 14 undergoes 2x turns whereupon the stop 20 moves again to arrest yarn discharge.

The points A, B, C and D are arranged so that with respect to the angular position of the main shaft they occur at equal spacings. If one device is used for one pick and then a second device is to be used for the next pick, the point A for the latter device occurs at the same position as point C for the former device so that it is ready to release yarn at the next spacing, i.e. at the next pick or shedding of the warp yarns. This is illustrated schematically in FIG. 2 wherein points A′ and B′ represent the relevant points of the second device 10. When the latter device reaches point B′ its arm 14 would have undergone 2x turns (i.e. x turns when decelerating previously from its point C to its point D plus x turns when accelerating from point A′ to B′). If however the same device is used to feed yarn for the next pick, then it remains running at insertion speed and undergoes 2x turns before reaching point B′ (this is shown by the chain dot line). Accordingly the same amount of yarn is stored on each device immediately prior to release of yarn whether the device is used intermittently or continuously.

The independent drive means for operating the metering device is preferably an electrically powered motor 81 as described above. However it will be appreciated that the drive means may take other forms, for instance a fluid powered motor or a clutch operated transmission deriving power from the loom. All these alternatives provide drive means which are intermittently operable.

By providing an intermittently operable drive means, the following advantages are achieved:

(1) the drive means for the yarn metering device 10 is controllable selectively so as to be activated at a predetermined time in each pick cycle of the loom;

(2) the drive means is capable of accelerating the yarn supply arm 14 from standstill to the yarn insertion speed in a known and selected number of whole turns around the fixed spool 12 prior to yarn release;

(3) the drive means is capable of decelerating the yarn supply arm 14 after yarn insertion from the insertion speed down to standstill in a known and selected number of whole turns around the spool 12; (4) the drive means is operative to move the yarn stop finger 20 alternatively between its yarn hold and yarn release positions each time after the yarn supply arm 14 has undergone a predetermined number of revolutions (i.e. 2x turns) around the spool 12.

The invention enables several yarn metering devices 10 to be interfaced with one another in a single weaving loom while permitting each device to operate either for a single pick or for successive picks, according to the fabric pattern selected. It is particularly important that all of the devices 10 in a loom have a known and selected amount of yarn wrapped on their spools at the time of yarn release, irrespective of whether the devide has just been actuated or whether it has been running for successive picks.

I claim:

1. A weaving loom including a plurality of weft metering devices for sequentially inserting selected weft yarns, each said weft metering device including a stationary spool, a yarn supply arm for wrapping yarn about the spool, movable stop means for controlling release of wrapped yarn from the spool during a pick, the stop means being movable between a yarn holding position whereat it restrains axial withdrawal of yarn windings from the spool and a yarn release position whereat it permits yarn windings to be drawn axially off the spool, selectively operable drive means drivingly connected for moving both the stop means and the supply arm in synchronism so that the stop means is repeatedly moved from one to the other of its said positions each time after the supply arm has been rotated through a predetermined number of complete rotations to thereby wrap said predetermined number of complete yarn windings on the spool and control means for the drive means operative to select the drive means for a selected pick, said drive means being capable when selected of accelerating from standstill to weft insertion speed prior to a selected pick, and decelerating from weft insertion speed to standstill after a selected pick, the drive means during said acceleration and the subsequent deceleration rotating the supply arm in total a number of complete rotations equal to said predetermined number.

2. A weaving loom according to claim 1, wherein each of the plurality of weft metering devices is provided with a low inertia motor, the motor of each being electronically controlled to enable different weft yarns to be sequentially inserted.

3. A weft metering device for a loom, the device including a stationary spool, a yarn supply arm for wrapping yarn about the spool, movable stop means for controlling release of wrapped yarn from the spool during a pick, the stop means being movable between a yarn holding position whereat it restrains axial withdrawal of yarn windings from the spool and a yarn release position whereat it permits yarn windings to be drawn axially off the spool, intermittently operable drive means for moving both the stop means and the supply arm in synchronism whereby the stop means is moved from one to the other of its said positions each time after the supply arm has been rotated through a predetermined number of complete rotations to thereby wrap plural complete yarn windings on the spool equal in number to said predetermined number and control means for the drive means operative to actuate the drive means for a selected pick, said drive means being capable when actuated of accelerating from standstill to weft insertion speed prior to a selected pick, and decelerating from weft insertion speed to standstill after a selected pick, the drive means, during said acceleration and said subsequent deceleration, rotating the supply arm a total number of complete rotations equal to said predetermined number.

4. A weft metering device according to claim 3 wherein the drive means is an electronically controlled low inertia motor.

5. A weft metering device according to claim 3 wherein the control means is a microprocessor.

* * * * *